US008800740B2

(12) United States Patent
Kurth

(10) Patent No.: US 8,800,740 B2
(45) Date of Patent: Aug. 12, 2014

(54) METHOD AND DEVICE FOR SEALING DIFFERENT OIL ENVIRONMENTS

(75) Inventor: Jürgen Kurth, Odenthal (DE)

(73) Assignee: Aktiebolaget SKF, Gothenburg (SE)

( * ) Notice: Subject to any disclaimer, the term of this patent is extended or adjusted under 35 U.S.C. 154(b) by 251 days.

(21) Appl. No.: 13/305,934

(22) Filed: Nov. 29, 2011

(65) Prior Publication Data

US 2012/0138416 A1 Jun. 7, 2012

(30) Foreign Application Priority Data

Dec. 2, 2010 (DE) ..... 10 2010 062 332

(51) Int. Cl.
*F16J 9/12* (2006.01)

(52) U.S. Cl.
USPC ..... 192/85.54; 192/98; 277/309; 277/437

(58) Field of Classification Search
USPC ..... 192/85.44, 85.54; 92/249, 254; 277/308–311
See application file for complete search history.

(56) References Cited

U.S. PATENT DOCUMENTS

| | | | | |
|---|---|---|---|---|
| 3,378,111 | A | 4/1968 | Greer et al. | |
| 5,810,145 | A * | 9/1998 | Thomire | 192/85.54 |
| 2004/0164496 | A1 * | 8/2004 | Okada et al. | 277/549 |

FOREIGN PATENT DOCUMENTS

| | | | |
|---|---|---|---|
| DE | 1575863 | A1 | 2/1970 |
| DE | 2216629 | A | 10/1989 |
| DE | 19536610 | A1 | 4/1997 |
| JP | 02188652 | A * | 7/1990 |

* cited by examiner

*Primary Examiner* — Richard M. Lorence
(74) *Attorney, Agent, or Firm* — Bryan Peckjian; SKF USA Inc. Patent Department

(57) ABSTRACT

A method and device are provided for sealing a first oil environment, which is located on a first side of a movable piston guided in a hollow chamber, from a second oil environment, which is located on a second side of the piston. The piston can move back and forth in the hollow chamber between the two oil environments in the axial direction by a piston stroke length (d). Two annular seal elements are disposed around the movable piston so as to sealingly contact the inner circumferential wall of the hollow chamber. The annular seal elements are spaced from each other by at least a distance (D) in the axial direction that is greater than or equal to the piston stroke length (d).

20 Claims, 3 Drawing Sheets

METHOD AND DEVICE FOR SEALING DIFFERENT OIL ENVIRONMENTS

CROSS-REFERENCE

The present application claims priority to German patent application no. 10 2010 062 332.6 filed on Dec. 2, 2010, the contents of which are incorporated herein by reference as if fully set forth herein.

TECHNICAL FIELD

The present invention generally relates to the sealing of two different oil environments, such as e.g., a device and a method for sealing a first oil environment, which is located on a first side of a movable piston guided in a hollow chamber, from a second oil environment located on a second (opposite) side of the piston.

BACKGROUND ART

In automatic transmissions, such as dual clutch transmissions, one or more hydraulically-operated actuators is/are often used for shifting the gears. In particular, such a hydraulically-operated actuator may be a hydraulic cylinder having a shift piston that can reciprocally move back and forth and/or up and down in a hollow chamber of a work cylinder. In such automatic transmissions, a shift rod is typically disposed within a shift cylinder and is affixed to the shift piston.

Shifting devices are also known that include a stepped piston, which is sealingly guided in a hollow chamber and/or work cylinder by a shift rod. The stepped piston can be affixed to the shift rod, e.g., with retaining rings. Sealing means are typically provided on the shift piston for sealing the two work chambers of the work cylinder relative to each other, such as e.g., seals vulcanized onto forged metallic piston elements. A similar shifting device includes stationary seals that seal against the piston rods, which are movable relative to the seals, and separate the two oil chambers. However, in such known embodiments, the seals can not reliably separate the two oils from each other.

Since different oil environments, i.e. different operating oils, can be utilized in different work chambers in modern automatic transmissions, in particular in dual clutch transmissions, it is necessary to reliably seal the work chamber of the work cylinder relative to the outer environment(s) in order to prevent the different oils from mixing together. For example, two oils may be utilized that are incompatible with each other, such as a hydraulic oil (e.g., automatic transmission fluid) for the hydraulic operation and a gear oil for the clutch package. In this case, the two oils may be present on opposite sides of the hydraulic piston.

Oil carryover or leakage past the seals and piston guides should be avoided due to the oil incompatibility or should at least be limited to an absolute minimum. Maintaining the necessary oil separation becomes even more challenging when the piston has an annular shape (annular piston).

SUMMARY

It is an object of the present teachings to disclose an improved method and device for sealing two oil environments, e.g., in a hydraulic cylinder, so that oil carryover and/or leakage past or over seals and piston guides can be avoided or at least substantially reduced.

In a hydraulic cylinder, a piston typically moves back and forth and/or up and down in a hollow chamber, such as e.g., in a work cylinder, in the axial direction, i.e. it is reciprocally moved in the direction of its longitudinal axis. The maximum length that the piston travels in one direction for each reciprocal movement is known as the "piston stroke" or "piston stroke length". According to one preferred aspect of the present teachings, at least first and second seal elements may be disposed on the movable piston so as to encircle the piston and contact the hollow chamber. The first and second seal elements are preferably spaced by at least a distance that corresponds to the piston stroke in the axial direction (i.e. along the longitudinal or rotational axis of the piston). That is, no other seal element(s) intervene(s) between the first and second seal elements.

According to one exemplary embodiment of the present teachings, the axially-separated seal elements reciprocally move together with the piston and/or a piston rod in the hollow chamber and/or in the work cylinder along a path that is shorter than the axial separation of the first and second seal elements, i.e. the two closest seal elements in the axial direction that provide an intermediate chamber between the first and second oil environments. Consequently, this minimum axial separation of the first and second seal elements prevents any oil smearing that is associated with each the seal elements from overlapping, which would otherwise lead to undesired oil carryover or leakage from one oil environment into the other oil environment (i.e. an undesirable oil mixing).

In another aspect of the present teachings, a device is provided for sealing a first oil environment, which is located on a first side of a movable piston guided in a hollow chamber, from a second oil environment, which is located on a second side of the piston. The piston can reciprocally move in the hollow chamber, which is located between the two oil environments, in the axial direction. The device preferably further comprises first and second seal elements encircling the movable piston and sealingly contacting the inner wall of the hollow chamber. The first and second seal elements are preferably spaced in the axial direction by at least a distance that corresponds to the piston stroke and preferably without any other seal element(s) intervening between the first and second seal elements. That is, the first and second (i.e. the closest) seal elements are axially separated by a distance that is at least as long as the maximum length of the piston movement in the axial direction. More preferably, the axial separation of the first and second seal elements may be, e.g., 20% more than the piston stroke, 40% more than the piston stroke, 50% more than the piston stroke, 75% more than the piston stroke or even at least two times the piston stroke.

The seal elements are preferably formed as elastic seal lips that encircle the piston in an annular manner (i.e. annular seal lips). The annular seal lips are preferably in constant contact with the inner surface of the hollow chamber so as to perform a sealing function between the piston and the inner surface of the hollow chamber.

In order to be able to more reliably prevent oil carryover when the piston axially moves within the hollow chamber, a support assembly optionally may be provided for the seal elements. In such an embodiment, the outer diameter of the support assembly in the region between the two seal elements is preferably smaller than the outer diameter of at least one of the seal elements. In other words, the outer diameter of the support assembly is smaller in the region between the two seal elements than the inner diameter of the hollow chamber and/or the work cylinder.

According to another aspect of the present teachings, a method is provided for sealing a first oil environment, which is located on a first side of a movable piston guided in a hollow chamber, from a second oil environment, which is located on a second side of the piston. The piston can axially reciprocally move between the two oil environments. In order to perform this sealing method, a first seal element, which is associated with the first oil environment, may be disposed on the movable piston so as to encircle the piston and sealingly contact the inner surface of the hollow chamber. In addition, a second seal element, which is associated with the second oil environment, is disposed on the movable piston so as to encircle the piston and sealingly contact the hollow chamber. The first and the second seal elements are spaced in the axial direction by at least a distance that corresponds to the reciprocating stroke length of the piston. That is, the axial separation of the seal elements is preferably equal to or greater than the maximum piston stroke length in one direction. More preferably, the axial separation of the first and second seal elements may be, e.g., 20% more than the piston stroke, 40% more than the piston stroke, 50% more than the piston stroke, 75% more than the piston stroke or even at least two times the piston stroke.

Thus, the present teachings provide a seal assembly on a piston having two seal elements that are axially separated by at least the piston stroke. The movement paths of the seal elements in the axial direction are determined by the piston stroke and never overlap due to this axial separation. If the two axially-opposing seal elements are disposed on a support assembly (rod), which does not contact the housing wall and/or the hollow chamber wall, a direct contact of the smeared oil films transported under the respective seal elements and/or seal lips can be reliably avoided.

Further objects, embodiments, advantages and designs will be explained in the following with the assistance of the exemplary embodiments and the appended Figures.

DETAILED DESCRIPTION OF THE INVENTION

Figure 1:
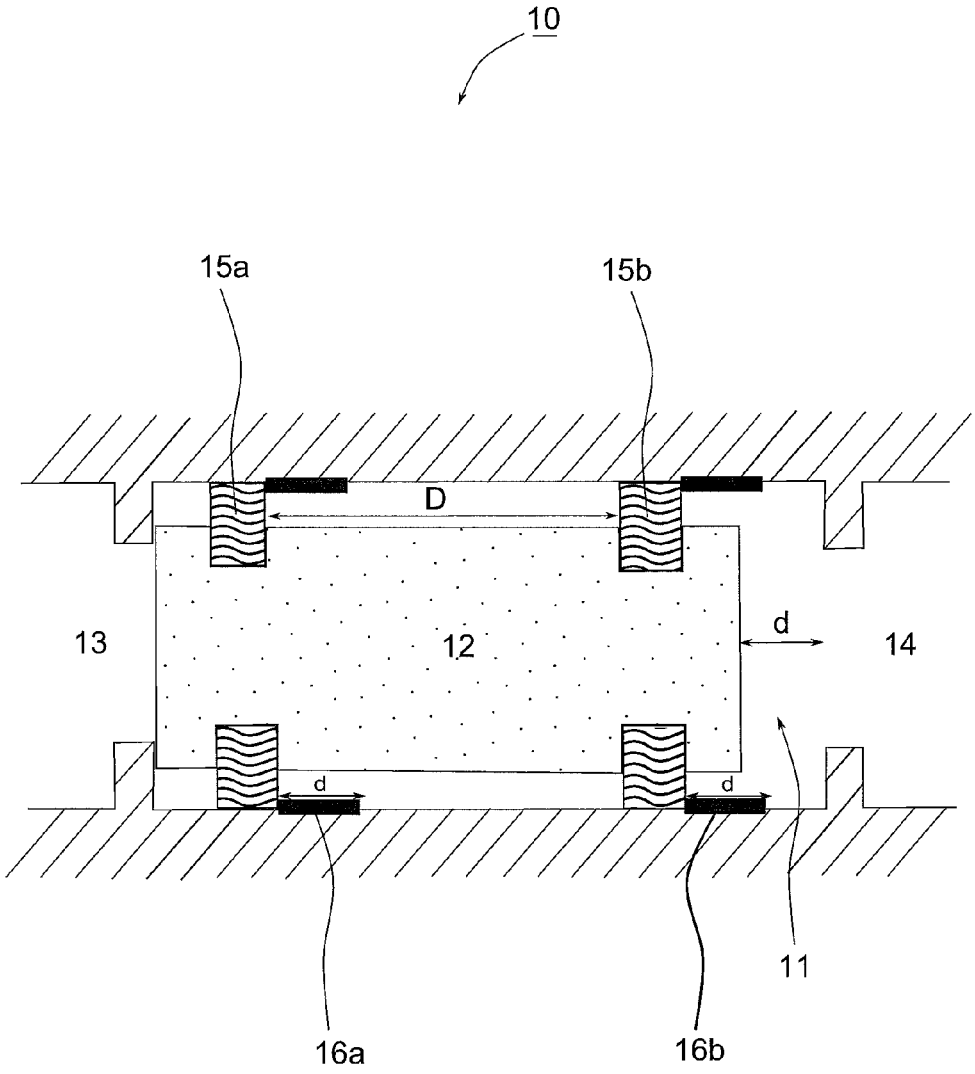
FIG. 1 shows a schematic cross-section of a first representative device for sealing two oil environments.

FIG. 1 shows a simplified, schematic longitudinal section of a device 10 configured to seal two different oil environments according to an exemplary embodiment of the present teachings.

The sealing device 10 serves to seal a first oil environment 13, which is located on a first side of a movable piston 12 guided in a hollow chamber 11, from a second oil environment 14, which is located on a second side of the piston 12 that is opposite of the first side in the axial direction of the piston 12. The piston 12 is (reciprocally) movable back and forth (or up and down) in the hollow chamber 11 between the two oil environments 13, 14 in the axial direction, i.e. along the longitudinal or rotational axis of the piston 12. The length of the piston movement in the axial direction is the piston stroke d. That is, the piston stroke d indicates the maximum path (length) that the piston 12 can cover or travel in the hollow chamber 11 in one direction. Two (first and second) seal elements 15*a* and 15*b* are disposed on the movable piston 12 in an encircling manner between the piston 12 and hollow chamber 11 and/or its inner wall. The two seal elements 15*a* and 15*b* are spaced by a distance D relative to each other in the axial direction. The axial separation D of the seal elements 15*a* and 15*b* is preferably at least equal to the piston stroke d. That is, the axial separation distance D of the seal elements 15*a*, 15*b* is preferably greater than or equal to the piston stroke d (D≥d).

According to the present teachings, any component that forms a sealed hollow chamber together with a stationary component (e.g., a work cylinder) is understood as falling within the scope of the term "piston". The volume of such a sealed hollow chamber can be changed. For example, a stepped piston or an annular piston, which has a piston rod coupled and/or connected therewith, should also be understood as falling within this term. The hollow chamber 11 can be the empty inner chamber of a hydraulic cylinder and/or a work cylinder, in which the piston 12 can be moved (reciprocally) as an actuator back and forth and/or up and down by the piston stroke d.

In one particularly preferred example of the present teachings, a hydraulic oil (e.g., automatic transmission fluid) serving as a pressing means can be located in the first oil environment 13, whereas a gear oil (e.g., hypoid oil) can be provided in the second oil environment. Such a two oil system may be utilized, e.g., in shifting devices in a vehicle transmission. Naturally, an inverse arrangement of oils and/or the usage of other oils is (are) also possible. The two types of oils in the different oil environments 13, 14 preferably should not be allowed to mix, so that, for example, the hydraulic oil environment 13 is reliably sealed relative to the gear oil and/or wheel set oil environment 14. In order to reliably achieve this oil separation during operation, the seal assembly preferably comprises the two seal elements 15*a*, 15*b* axially spaced by a distance (D) that is greater than or equal to the piston stroke length d. Further, no additional seal element(s) is (are) disposed between the two seal elements 15*a*, 15*b*.

As is indicated in the cross-sectional illustration of FIG. 1, annular elastomeric seal rings, such as e.g., O-rings, or seal lips are disposed around the circumference of the piston 12 and/or its piston rod and serve as the seal elements 15*a*, 15*b*. The radially outer end portions thereof are in sealing contact with an inner wall of the hollow chamber in order to perform a sealing function between the piston 12 and/or its piston rod and the inner wall of the hollow chamber. In the exemplary embodiment shown in FIG. 1, the piston 12 can have, e.g., annular grooves that are spaced from each other by the distance D and respectively receive (retain) the annular seals 15*a*, 15*b*.

In order to prevent oil from smearing or leaking through a portion of the piston and/or its piston rod between the two annular seal elements 15*a*, 15*b*, the portion of the piston 12 disposed between the two seal elements 15*a*, 15*b* has a smaller outer diameter than the outer diameter(s) of the seal element(s) 15*a*, 15*b*. More particularly, the outer diameter of the piston in the region between the two seal elements 15*a*, 15*b* is smaller than the inner diameter of the hollow chamber 11 guiding the piston 12. In this case, it can be ensured that only the seals 15*a*, 15*b* contact the inner wall of the hollow chamber. That is, it is preferred that no portion of the piston 12 or any other structure disposed between the two seal elements 15*a*, 15*b* contacts the inner wall of the hollow chamber, such that there is an axial separation of contacting parts (i.e. the seal elements 15*a*, 15*b*) disposed on the piston 12 that is at least as long as the piston stroke d, and more preferably the axial separation is greater than the piston stroke d.

By setting the axial separation of the seal elements 15*a*, 15*b* as D≥d and by designing the middle (intervening) portion of the piston 12 so that no intervening structure contacts the hollow chamber, an advantageous seal assembly results that can reliably maintain the separation of the two oil environments, which are on the left and right, from each other. Thus, even if oil films (oil smears) 16*a* and/or 16*b* respectively form in each contact area between the radially outer ends of the seal elements 15*a*, 15*b* and the inner wall of the hollow chamber, such oil films 16*a*, 16*b* formed by the axial movement of the piston 12 would at most have an axial length equal to the piston stroke d between the two axially-extreme positions of seal elements 15*a*, 15*b*. That is, the maximum extension or length of the oil films 16*a*, 16*b* on the inner surface of the hollow chamber would corresponds (be equal) to the piston stroke d. Thus, by setting axial separation of the annular seal elements 15*a*, 15*b* encircling the piston 12 as D≥d, in practice, the oil films 16*a*, 16*b* respectively associated with the seal elements 15*a*, 15*b* never come into contact on the inner surface of the hollow chamber. Therefore, undesired oil carryovers (mixing) past the seals and piston guides are avoided.

That is, due to the axial separation D≥d, there is no overlapping of the movement paths of the seal elements 15*a* and 15*b* (generated by the piston stroke d) and thus also no overlapping of the oil films 16*a*, 16*b* associated with the seal elements 15*a*, 15*b* on the inner surface of the hollow chamber. The resulting oil-film-free area on the inner surface of the hollow chamber between the seal elements 15*a*, 15*b* ultimately also prevents the above-described disadvantageous oil carryovers between the two oil environments 13 and 14, which lie to the left and right of the piston 12 in FIG. 1.

Although sealing devices constructed in accordance with the present teachings can be utilized in many different fields of technology, one exemplary embodiment of a seal assembly will be described in the following with the assistance of FIG. 2, which is a seal assembly utilized in a vehicle transmission, such as e.g., an automatic and/or dual clutch transmission. Consequently, exemplary embodiments of the present teachings also comprise vehicle transmissions having sealing devices.

Figure 2:
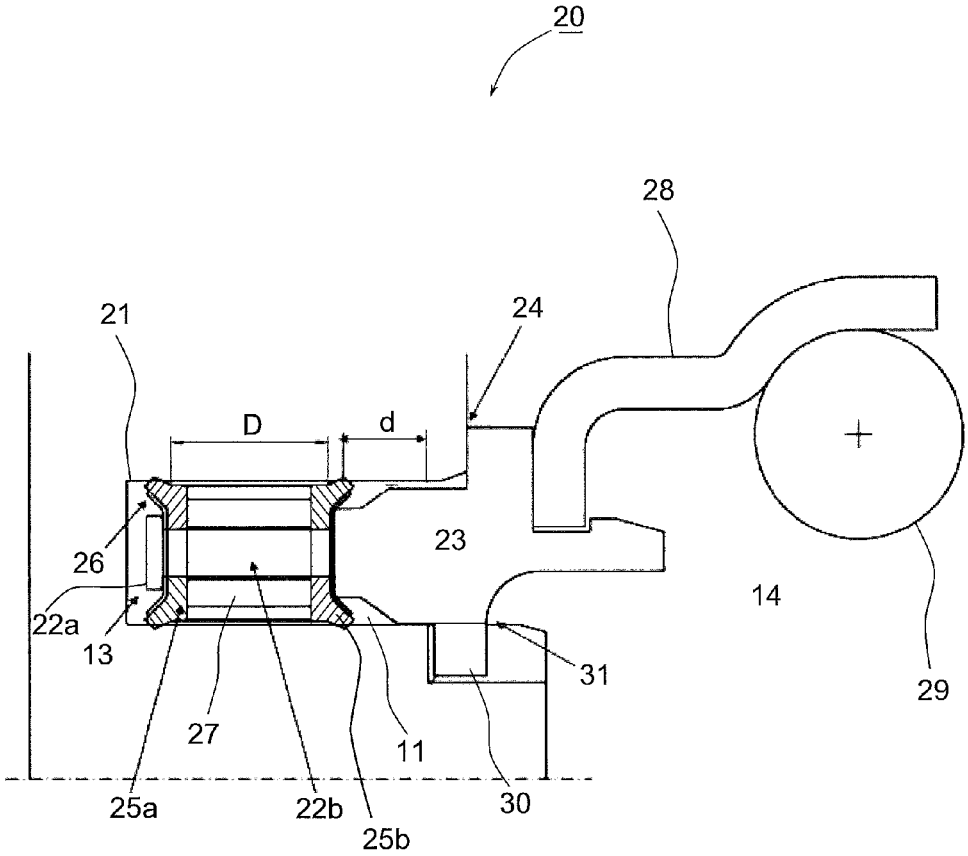
FIG. 2 shows a schematic cross-sectional illustration of a second representative device for sealing two oil environments.

FIG. 2 shows a schematic longitudinal-section of a device 20 configured to seal two different oil environments 13, 14, which can be utilized, e.g., in a dual clutch transmission according to this exemplary embodiment.

The hydraulic device 20 comprises a work cylinder 21 having a hollow chamber 11, in which an annular piston 22*a* and a piston rod 22*b* can be reciprocally moved by a guide element 23. The piston 22*a* and rod 22*b* are moved by a piston stroke (length) d in the axial direction between two axial end stops within a guide bore 31. In particular, the end stop indicated by reference number 24 can prevent the piston assembly 22*a*, 22*b* from striking the left hollow chamber floor.

The guide element 23 for the piston assembly 22*a*, 22*b* is prevented from twisting (rotating) within the guide bore 31 by a radial projection 30 and a corresponding recess in the guide bore 31, which together form an anti-twist device.

In the present example, a roller bearing 29, such as e.g., a clutch release (throw-out) bearing, is reciprocally moved by the hydraulic assembly via an arm 28.

In order to seal a left-side (with reference to FIG. 2) hydraulic oil environment 13 relative to a right-side gear oil environment 14, two (first and second) axially-spaced seal elements 25*a* and 25*b* are provided on the annular piston 22*a* and/or on its piston rod 22*b* in a sealing area. The seal elements 25*a* and 25*b* encircle the piston rod 22*b* (as a part of the piston assembly 22*a*, 22*b*) in an annular manner and radially extend up to the inner wall of the work cylinder 21 and/or the hollow chamber 11. Consequently, it is not possible for significant amounts of oil to seep through between the respective radial ends of the annular seal elements 25*a* and 25*b* and the inner wall of the hollow chamber. As has already been described above, the axial separation D between the two annular seal elements 25*a* and 25*b* is greater than or equal to the axial piston stroke length d. For example, the axial separation D can be approximately twice the piston stroke length d, i.e. D≈2d.

As can be seen in the longitudinal section of FIG. 2, each of the seal elements 25*a*, 25*b* can comprise an elastic and/or elastomeric seal lip encircling the piston 22*a* and/or the piston rod 22*b* in an annular manner. The radially outer end of each annular seal lip sealingly contacts the annular inner surface of the hollow chamber 11 and/or the work cylinder 21 (inner surface of the hollow chamber) in order to perform a sealing function between the piston 22*a* and/or the piston rod 22*b* and the inner surface of the hollow chamber.

According to a preferred exemplary embodiment, each of the two seal elements 25*a*, 25*b* can further comprise a spring-type or resilient assembly 26 that imparts a return (biasing or urging) force towards the inner surface of the hollow chamber in order to press the seal lips of the seal elements 25*a* or 25*b* against the inner surface of the hollow chamber. For this purpose, the resilient assembly 26 can comprise, e.g., spring elements disposed equidistantly in the circumferential direction of the annular, encircling seal lip 25*a* or 25*b*. The spring elements are preferably configured to press the radial ends of the respective seal lips 25*a* or 25*b* in the circumferential direction substantially uniformly against the inner surface of the hollow chamber 11 (inner surface of the hollow chamber). In other words, a uniform annular contact pressure of the seal lips 25*a*, 25*b* can be achieved, e.g., by fan-shaped springs 26, in order to compensate for any negative influences during operation, such as e.g., hardening or stiffening of the elastomeric material (elastomer) of the seal lips 25*a*, 25*b* at low temperatures and/or deterioration of the material.

In one particularly preferred embodiment, the spring elements 26 of the resilient assembly are configured to press the seal lips 25*a*, 25*b* against the annular cylinder wall in a temperature-dependent manner. To achieve this function, the spring elements 26 can be made, e.g., from spring steel. In this case, by using the spring elements 26, an insufficient following behavior of the elastomeric seal lips 25*a*, 25*b* at low temperatures can be avoided, in addition to improving the intrinsic oil separation properties of the sealing device.

However, instead of the spring-type or resilient assembly 26, a clamping ring or the like could also be provided in order to press the seal elements 25*a*, 25*b* as uniformly as possible against the inner surface of the hollow chamber. The present teachings are not particularly limited in this regard.

Referring again to FIG. 2, a support element 27 is provided to support and/or retain the two seal elements 25*a*, 25*b* and can be disposed on the movable piston 22*a* and/or its piston rod 22*b* between the seal elements 25*a*, 25*b*. The support element 27 itself can be affixed around the piston 22*a* and/or the piston rod 22*b* in a rotationally-symmetric manner, e.g., by shrink fitting on the piston rod 22*b* or by a similar joining mechanism. The support element 27 for the two seal elements 25*a*, 25*b* can be formed, e.g., from a metallic or polymer material, such as e.g., from aluminum or reinforced plastic.

According to the exemplary embodiment shown here, the annular seal elements 25*a*, 25*b* can be disposed on axial ends, i.e. virtually on the annular end faces, of the support element 27. The seal elements and/or the seal lips 25*a*, 25*b* can be, e.g., adhered or screwed together with the end faces of the support element 27. However, other friction-fit connections may also be utilized with the present teachings.

The outer diameter of the seal elements and/or the seal lips 25*a*, 25*b* is preferably larger than the outer diameter of the assembly and/or the support element 27 in the region between the two seal elements 25*a*, 25*b*. In other words, the outer diameter of the assembly 27 between the two seal lips 25*a*, 25*b* should be smaller than the inner diameter of the hollow chamber 11 guiding the piston 22*a*, 22*b*, so that the region or extension of the outer surface(s) of the support element 27, which is between the two seal lips 25*a*, 25*b*, does not contact the inner wall of the hollow chamber, thereby avoiding disadvantageous oil carryover. That is, it is preferable that only the seal elements and/or seal lips 25*a*, 25*b*, and not also a region 27 therebetween, are in physical contact with the inner surface of the hollow chamber. In this case, a chamber filled with air or another medium is formed between the two seal elements and/or seal lips 25*a*, 25*b* such that the two oil films 16*a*, 16*b* can not mix in this intervening region.

As is clear from FIG. 2, the piston guidance in the hydraulic device 20 is thus shifted from the sealing area to a housing. The piston guidance is undertaken by the guide element 23 in the diameter of the guide bore 31. A radial gap between the guide element 23 and the guide bore 31 is narrower than the gap between the assembly 27 between the two seal lips 25*a*, 25*b* and the cylinder wall.

After having described in the preceding different exemplary embodiments of devices that include inventive seal devices, for the sake of completeness, an exemplary embodiment of a method for sealing two different oil environments will be provided in the following.

Figure 3:
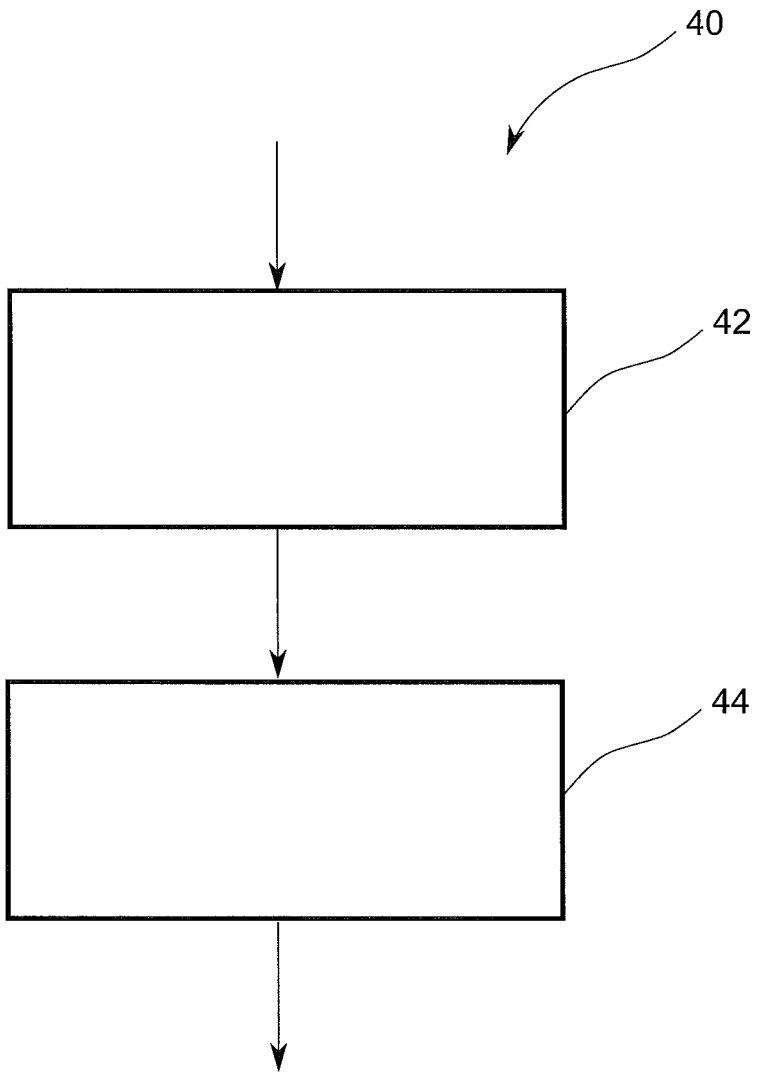
FIG. 3 shows a schematic illustration of a flow diagram of a representative method for sealing two oil environments.

To this end, FIG. 3 shows a schematic flow chart of a method 40 for sealing a first oil environment 13, which is located on a first side of a movable piston 12, 22*a*, 22*b* guided in a hollow chamber 11, from a second oil environment 14, which is located on a second side of the piston 12, 22*a*, 22*b*. The piston 12, 22*a*, 22*b* can be axially moved back and forth and/or up and down (reciprocally) between the two oil environments 13, 14 by a piston stroke (length) d. A hydraulic assembly, which is positively sealed between two oil environments, can be practically produced by the below-described method 40.

The method 40 comprises a first step 42, in which a first seal element 15*a*, 25*a* associated with the first oil environment 13 is disposed on the movable piston 12, 22*a*, 22*b* in a manner such that it encircles the piston 12, 22*a*, 22*b* and sealingly contacts the hollow chamber 11.

In a second step 44, a second seal element 15*b*, 25*b* associated with the second oil environment 14 is disposed on the movable piston 12, 22*a*, 22*b* in a manner such that it encircles the piston 12, 22*a*, 22*b* and sealingly contacts the hollow chamber 11, so that the first and the second seal elements are disposed in the axial direction at a separation D that is greater than or equal to the piston stroke (length) d ($D \geq d$) and preferably no other intervening structure contacts the hollow chamber 11.

For example, the seal elements can be respectively affixed and/or disposed on opposite axial ends of the movable piston 12, 22*a*, 22*b*, so that they can not shift or displace in the axial direction relative to each other. In order to achieve this feature, the seals may be retained in respective annular grooves or the seal lips described with the assistance of FIG. 2 may be affixed on end faces of a spacer and/or support 27.

Such a method according to the exemplary embodiments of the present teachings can be utilized, e.g., in the assembly of transmission parts and/or clutch assemblies, in order to avoid and/or reduce detrimental oil mixing between hydraulic oil and gear oil in hydraulic applications.

A separation of basic functions of the components and/or the hydraulic assembly underlies the exemplary embodiments of the present teachings. The seal lips of the annular hydraulic oil seal 15*a*, 25*a* are spatially separated from the seal lips 15*b*, 25*b* on the gear oil side by at least the piston stroke (length) d. Guides of the seal assembly towards the cylinder and/or hollow chamber wall are set or placed outside of the double-acting (seal and guide of the piston in the guide bore 31) seal contact surfaces. The contact pressure of the seal lips 15*a*, 15*b*, 25*a*, 25*b* can be bolstered by providing, e.g., fan-shaped springs, in order to compensate for negative influences caused during operation, such as hardening of the elastomeric material at low temperatures and/or material deterioration. A support element 27, which is formed, e.g., from toughened-hardened steel or a polymer material, such as e.g., aluminum or reinforced plastic, can retain the seal components 15*a*, 15*b*, 25*a*, 25*b* and can guide the seal assembly relative to the housing and/or to the hollow space and can contact other shiftable transmission components, such as e.g., one or more roller bearings 29.

The spatial separation of the two axially-opposite seal elements 15*a*, 15*b*, 25*a*, 25*b*, and the chamber formed thereby in the intermediate space, in which the seal assembly does not contact the housing wall, can avoid and/or reduce a direct contact of the smeared oil films transported under the seal lips 15*a*, 15*b*, 25*a*, 25*b*. Fan-shaped springs can ensure a sufficiently high contact pressure and elastic conformation of the seal lips 15*a*, 15*b*, 25*a*, 25*b* in shape and position deviation due to transmitted shear forces over the entire temperature range of the hydraulic application.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved sealing devices and methods for manufacturing and using the same.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

10 Device for sealing two oil environments
11 Hollow chamber for piston
12 Piston
13 First oil environment
14 Second oil environment
15 Seal element
16 Oil film
20 Device for the sealing of two oil environments

21 Work cylinder
22 Annular piston
23 Piston rod
23 Piston guide element
24 End stop
25 Seal element
26 Spring
27 Support for seal elements
28 Arm
29 Roller bearing
30 Anti-twist device
31 Guide bore
40 Method for the sealing of two oil environments
42 Disposing a first seal element
44 Disposing a second seal element at separation D≥d

The invention claimed is:

1. A device for sealing a first oil environment from a second oil environment, comprising:

a hollow chamber, a piston configured to reciprocally move in the hollow chamber by a maximum stroke length in an axial direction, wherein the first oil environment is located on a first side of the piston and the second oil environment is located on a second side of the piston that is axially opposite of the first side of the piston, first and second annular seal elements disposed on the piston and sealingly contacting an inner circumferential wall of the hollow chamber, wherein the seal elements are spaced by at least a distance in the axial direction that is greater than or equal to the maximum stroke length, and a support element configured to support the seal elements, wherein the support element is disposed on the piston between the two seal elements and the seal elements are disposed on opposite axial ends of the support element.

2. The device according to claim 1, wherein each seal element comprises an annular elastic seal lip that is in sealing contact with the inner circumferential wall of the hollow chamber.

3. The device according to claim 2, wherein no structure intervening between the first and second annular seal elements contacts the inner circumferential wall of the hollow chamber.

4. The device according to claim 3, further comprising:

at least one spring element applying a biasing force against each seal lip towards the inner circumferential wall of the hollow chamber.

5. The device according to claim 4, wherein the at least one spring element comprises a plurality of spring elements disposed equidistantly in a circumferential direction of the annular seal lips and configured to apply a substantially uniform pressure to the seal lips around the circumference of the seal lips.

6. The device according to claim 5, wherein the spring elements each have a fan shape.

7. The device according to claim 6, further comprising:

a support element configured to support the seal elements, wherein the support element is disposed on the piston between the two seal elements and the seal elements are disposed on opposite axial ends of the support element.

8. The device according to claim 7, wherein the support element is comprised of one of a metallic material and a polymer material and the seal elements are comprised of an elastomeric material.

9. The device according to claim 8, wherein automatic transmission fluid is disposed in the first oil environment and hypoid oil is disposed in the second oil environment.

10. The device according to claim 9, wherein an outer diameter of the support assembly between the two annular seal elements is less than the outer diameters of the annular seal elements, wherein the support assembly does not contact the inner circumferential wall of the hollow chamber.

11. A vehicle transmission, comprising:

a roller bearing and the device according to claim 10, wherein the piston is fixedly connected to the roller bearing.

12. The device according to claim 1, wherein an outer diameter of the support assembly between the two annular seal elements is less than the outer diameters of the annular seal elements, wherein the support assembly does not contact the inner circumferential wall of the hollow chamber.

13. The device according to claim 1, wherein the seal elements are comprised of an elastomeric material.

14. The device according to claim 1, wherein a hydraulic oil is disposed in the first oil environment and a gear oil is disposed in the second oil environment.

15. The device according to claim 1, wherein no structure intervening between the first and second annular seal elements contacts the inner circumferential wall of the hollow chamber.

16. A vehicle transmission, comprising:

a roller bearing and the device according to claim 1, wherein the piston is fixedly connected to the roller bearing.

17. The vehicle transmission according to claim 16, wherein automatic transmission fluid is disposed in the first oil environment and hypoid oil is disposed in the second oil environment.

18. A method for sealing a first oil environment, which is located on a first side of a movable piston guided in a hollow chamber, from a second oil environment, which is located on a second side of the piston, wherein the piston is reciprocally movable in the hollow chamber between the first and second oil environments in the axial direction by a maximum piston stroke length, the method comprising:

disposing a first annular seal element associated with the first oil environment around the movable piston so as to sealingly contact an inner annular wall of the hollow chamber, disposing a second seal element associated with the second oil environment around the movable piston so as to sealingly contact the inner annular wall of the hollow chamber, wherein the first seal element is spaced from the second seal element in the axial direction by at least at a distance that is greater than or equal to the maximum piston stroke length, and disposing a support element on the piston between the two seal elements, wherein the seal elements are disposed on opposite axial ends of the support element, and wherein the support element is configured to support the seal elements.

19. The method according to claim 18, further comprising disposing a hydraulic oil in the first oil environment and disposing a gear oil in the second oil environment.

20. A vehicle transmission, comprising:

a roller bearing, and a device for sealing a first oil environment from a second oil environment, the device comprising:

a hollow chamber, a piston fixedly connected to the roller bearing and configured to reciprocally move in the hollow chamber by a maximum stroke length in an axial direction, wherein a first oil environment is located on a first side of the piston and a second oil environment is located on a second side of the piston that is axially opposite of the first side of the piston, and first and second annular seal elements disposed on the piston and sealingly contacting an inner circumferential wall of the hollow chamber, wherein the seal elements are spaced by at least a distance in the axial direction that is greater than or equal to the maximum stroke length.

* * * * *